US006578253B1

(12) United States Patent
Herbert

(10) Patent No.: US 6,578,253 B1
(45) Date of Patent: Jun. 17, 2003

(54) TRANSFORMER AND INDUCTOR MODULES HAVING DIRECTLY BONDED TERMINALS AND HEAT-SINK FINS

(75) Inventor: Edward Herbert, Canton, CT (US)

(73) Assignee: FMTT, Inc., Canton, CT (US)

( * ) Notice: Subject to any disclaimer, the term of this patent is extended or adjusted under 35 U.S.C. 154(b) by 0 days.

(21) Appl. No.: 08/236,378

(22) Filed: May 2, 1994

Related U.S. Application Data

(63) Continuation-in-part of application No. 07/771,603, filed on Oct. 4, 1991, now abandoned.

(51) Int. Cl.[7] ..... H01E 7/06

(52) U.S. Cl. ..... 29/605; 29/602.1; 336/192; 336/210

(58) Field of Search ..... 29/602.1, 605; 336/192, 210, 61, 60

(56) References Cited

U.S. PATENT DOCUMENTS

| | | | | | |
|---|---|---|---|---|---|
| 2,529,653 | A | * | 11/1950 | Epstein | 336/192 |
| 3,188,592 | A | * | 6/1965 | Kukla | 336/210 X |
| 3,387,245 | A | * | 6/1968 | Czernobil | 336/192 |
| 3,474,371 | A | * | 10/1969 | Miller | 336/192 X |
| 3,479,563 | A | * | 11/1969 | Roy | 336/192 X |
| 4,769,900 | A | * | 9/1988 | Morinaga et al. | 336/192 X |
| 4,804,340 | A | * | 2/1989 | Hamer et al. | 336/192 X |

FOREIGN PATENT DOCUMENTS

| | | | | |
|---|---|---|---|---|
| AU | 285678 | * | 9/1966 | 336/192 |
| DE | 621987 | * | 11/1935 | 336/61 |
| JP | 0220506 | * | 9/1988 | 336/192 |

* cited by examiner

*Primary Examiner*—Carl J. Arbes
(74) *Attorney, Agent, or Firm*—Michael J. Persson; Lawson & Persson, P.C.

(57) ABSTRACT

A matrix transformer and/or inductor module has its terminations bonded rigidly to the ferrite core of which it is made. Because the ferrite core is strong and dimensionally stable, the terminations are rugged and precisely located, important criteria for assembly to printed circuit boards and the like, especially if automated assembly methods are used. In another embodiment, the module has top and bottom metal plates which are the high current output terminals. This module can be mounted sandwiched between live heat sinks. In another embodiment, deep grooves are made into the core material, and fins are bonded into the grooves. The grooves reduce core losses by reducing eddy currents and dimensional resonance effects, and the fins remove heat from within the core allowing operation at much higher flux density and frequency.

3 Claims, 1 Drawing Sheet

TRANSFORMER AND INDUCTOR MODULES HAVING DIRECTLY BONDED TERMINALS AND HEAT-SINK FINS

This is a continuation in part application of High Frequency Matrix Transformer and Inductor Modules Ser. No. 07/771,603 filed Oct. 4, 1991, now abandoned.

BACKGROUND OF THE INVENTION

This invention relates generally to power converters, and more particularly to switched-mode power converters using matrix transformers and inductors.

The matrix transformer is described in U.S. Pat. No. 4,665,357 issued May 12, 1987 U.S. Pat. No. 4,85,606, issue Jul. 4, 1989, U.S. Pat. No. 4,942,353 issued Jul. 17, 1990, U.S. Pat. No. 4,978,906 issued Dec. 18, 1990 and U.S. Pat. 5,093,646 issued Mar. 3, 1992, all assigned to the same assignee as the present invention, and the disclosures of which are all incorporated herein by reference.

This invention teaches improved matrix transformer and inductor modules having improved ruggedness, and more precise location of their terminations.

SUMMARY OF THE INVENTION

The modules of the present invention use ferrite cores which are sturdy and have well defined dimensions. The terminations of the modules are bonded to the cores to provide ruggedness and dimensional stability to the terminations.

The modules may have square holes for pre-wired windings. In one embodiment, the top and bottom surfaces, respectively, are the terminations of the module.

DESCRIPTION OF THE PREFERRED EMBODIMENTS

The use of matrix transformer and inductor modules is shown in U.S. Pat. No. 4,942,353.

Figure 1:
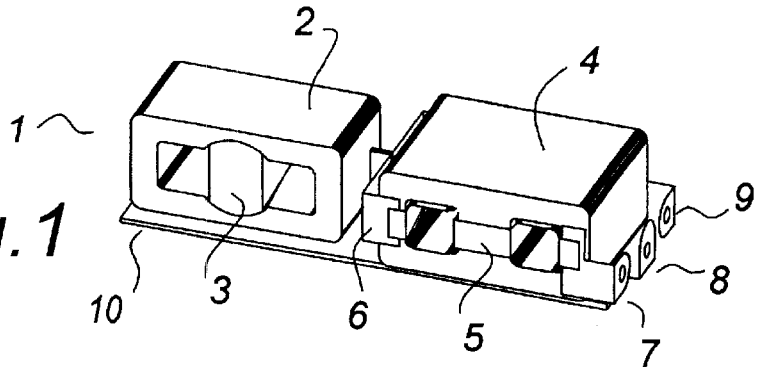
FIG. 1 shows a matrix transformer and inductor module.

FIG. 1 shows a matrix transformer and inductor module 1 of the present invention having an inductor core 2 with an insert 3 and a transformer core 4 mounted on a base plate 10. The transformer core has a secondary winding 5 installed therein.

The transformer cores and the inductor cores of this invention are "solid magnetic cores", meaning that they are of a solid material such as ferrite or sintered powdered iron, as illustrations, not limitations. If the solid magnetic core comprises more than one part, for instance, a two part E-E core, an E-I core, a U-U core, a U-I core, a pot core or any of many two part cores which would be familiar to one skilled in the art, at least the parts to which the terminals are to be bonded are fixed together immovably as by cementing or the like as an illustration, not a limitation, so that the solid core where the terminals are to be bonded is rigid and has good mechanical integrity. If the core comprises a stack of laminations, then the laminations are fixed together immovably as by bonding or welding or the like as illustrations, not limitations, so that the stack where the terminals are to be bonded is rigid and has good mechanical integrity.

"If the solid magnetic core is of conductive or semiconductive material, then the "solid magnetic core" may include a thin insulating film, coating or layer on its surface to make its surface non-conductive, for example and not a limitation, electrostaticly deposited epoxy."

Terminations 7, 8 and 9 are provided for direct installation of an industry standard rectifier.

As shown the secondary winding 5 is a center-tapped secondary winding, the center-tap comprising a connecting strap 6.

It is understood that the several parts of the windings must be insulated from each other. If the core material is conductive, they must be insulated from the core as well. An effective method of insulating a core is by coating it with an insulating layer such as epoxy. It is also common to partially coat conductors with an insulating layer. This is well understood by one familiar with the art, but it is not a point of novelty of the invention. Some core materials, such as nickel ferrite, are good insulators, and need not be insulated.

FIG. 1 shows how the matrix transformer and inductor module might be constructed as a general purpose component for power converters. The transformer core 4 and its secondary winding 5 may be designed for a particular output voltage and frequency of operation. In different applications several modules are typically used and may be wired in parallel. The number and arrangement of the modules may vary for different input voltages, different primary winding configurations and different power levels, but as long as the output voltage and frequency of operation are consistent, the one part is suitable. Windings to be added to the inductor core 2 and the insert 3 may vary from application to application.

The inductor core 2 and the transformer core 4 are bonded securely to the base plate 10. The terminals 7, 8 and 9 are also bonded to but insulated from the transformer core 4. Terminal 8 may or may not be common to the base plate 10 as a design option.

An important feature of FIG. 1 is that by bonding the terminations 7, 8 and 9 directly to the transformer core 4, they are securely and precisely located, and are very rugged. This makes it practical to use a matrix transformer and inductor module as an unencapsulated assembly, for economy, and for access to the inductor core 2 and its insert 3 for adding the inductor winding.

Figure 2:
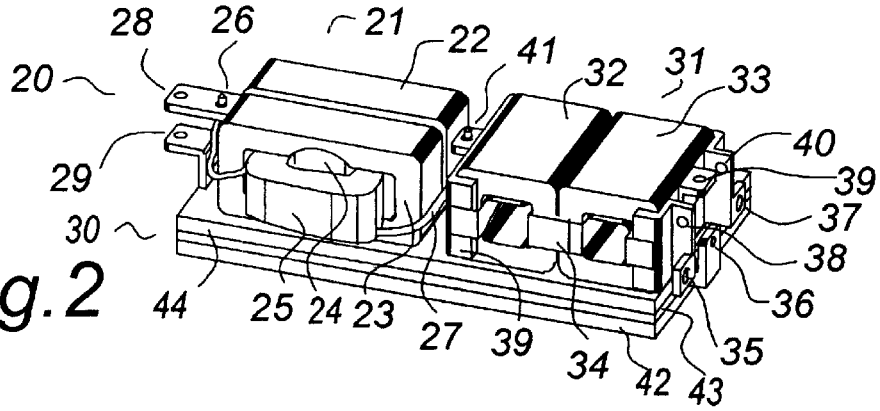
FIG. 2 shows another embodiment of a matrix transformer and inductor module.

FIG. 2 shows a matrix transformer and inductor module 20 which in many respects is similar to the matrix transformer and inductor module 1 of FIG. 1. An inductor 21 comprising two ferrite cores 22 and 23 with an insert 24, and a transformer 31 comprising two ferrite cores 32 and 33 are mounted on a base plate 30.

The base plate 30 may optionally be a two layer assembly the top layer 44 of which is common to the terminal 8 and the bottom layer 42 of which is an insulated heat sink mounting surface. An insulation layer 43 separates the top layer 44 from the bottom layer 42.

The inductor 27 has a winding 25 with a first termination 23 and a second termination 26. One inductor winding 25 may be suitable for a wide range of applications, as the current through it is largely determined by the rating of the rectifier with which it is used and its value is largely determined by the tolerable ripple voltage and the filter capacitor with which it is to be used. These may be consistent for many applications.

The inductor 21 is terminated at an output terminal 28 and at a center-tap terminal 41 of the transformer 31. The center-tap terminal 41 is part of a center-tap connection 39.

Terminals 35, 36 and 37 are provided for direct connection to an industry standard rectifier. Additional terminals 38, 39 and 40 may be provided for ancillary components such as snubbers, if used. As shown, terminal 36 is common with the base plate 30 and an output terminal 29. Alternatively terminals 29 and 36 may be connected to each other but insulated from the base plate 30.

Figure 3:
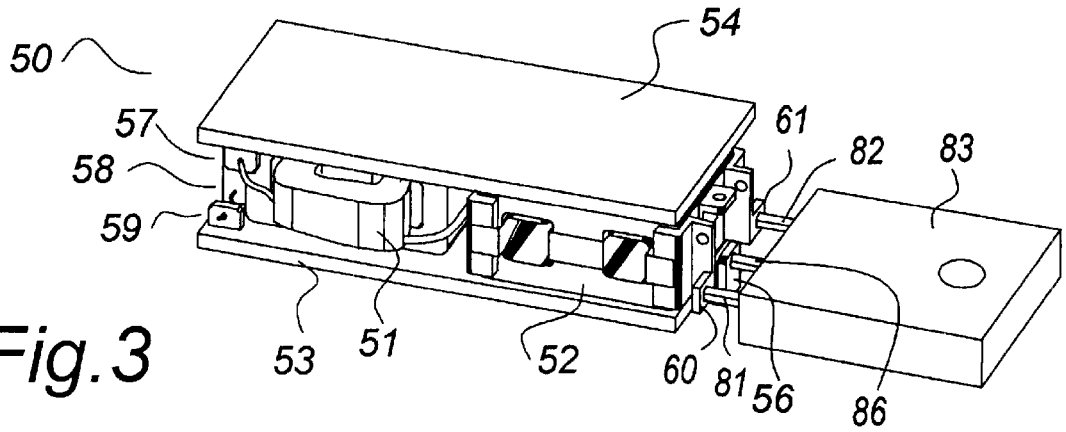
FIG. 3 shows a matrix transformer and inductor module in which the top and bottom surfaces are the output terminations.

FIG. 3 shows a matrix transformer and inductor module 50 which has many features which are common with the matrix transformer and inductor module 20 of FIG. 2. These common features are not identified and discussed again unless further aspects of the invention would be shown.

An inductor 51 and a transformer 52 are mounted between a base plate 53 and a top plate 54. The base plate 53 may be common to a terminal 56, and may be the positive output termination for the matrix transformer and inductor module 50. The inductor 51 may be connected to the top plate 54 through a connection 57, and the top plate 54 may be the negative output termination for the matrix transformer and inductor module 50. A capacitor 58 may also be connected to the top plate 54 at the connection 57 and to the bottom plate 53 through a connection 59, and may serve as an output filter capacitor.

FIG. 3 shows that the top plate 54 covers the top of the inductor 51 and the transformer 52, and the bottom plate 53 covers the bottom of the inductor 51 and the transformer 52. For the purpose of this specification and the claims, a top or a bottom plate "covers" a top or a bottom surface of a core or cores if the top or the bottom plate is proximate to the top or the bottom surface of the core or cores and extends over at least most of the top or the bottom surface of the core or cores.

FIG. 3 shows a rectifier 83 connected to terminals 56, 60 and 61 of the module 50. The rectifier has a first anode 81 and a second anode 82, and a common cathode which is its bottom surface and center terminal, which may be connected to the base plate 53 using terminal 56.

One intended use of the matrix transformer and inductor module 50 is in a power converter comprising a number of similar matrix transformer and inductor modules which are mounted sandwiched between live heat sinks. A "live heat sink" is one which both conducts heat and electrical current, so it must be in good thermal and electrical contact with the matrix transformer and inductor module 50 and the other matrix transformer and inductor modules with which it is used, but must be insulated from other components to which there must not be an electrical contact. Heat sinks are normally robust, and are often of materials having good electrical conductivity. It provides significant savings in weight and volume as well as cost if the functions can be combined, eliminating bus bars and the like.

The transformer core 4 is preferably made of ferrite, though it would be functionally equivalent to construct it of another magnetic material having suitable properties. If it is made of multiple parts, for instance a stack of laminations, they must be bonded rigidly together so the core as a whole becomes a solid piece having structural integrity and reasonably good dimensional stability. If the magnetic core 4 is made of a conductive material, such as a manganese zinc ferrite or steel laminations, then it must be insulated at least over the portions of its surface which would contact the winding 5 or the terminals 6, 7 and 9. The insulation may be a thin coating such as epoxy. Coating magnetic cores is a usual process in the art. If the core 101 is of a non-conductive material such as nickel ferrite, it need not be insulated.

There are some advantages to using two cores 32 and 33 for the magnetic structure which offset the inconvenience of handling two parts (in contrast to using a core such as the core 4 of FIG. 1). One is that eddy current losses will be less. It is often assumed that eddy current losses in ferrites are negligible, but that is not necessarily the case at high frequencies. Another is the simplicity of tooling. The two pieces may net out to a lower cost than the one part core. Another is that the tolerance between the holes of a dual core 4, with reference to FIG. 1, may be hard to hold due to variations in shrinkage during cure. Any variation can be eliminated when two core parts 32 and 33 with reference to FIG. 2 are bonded together by varying the amount and thickness of the bonding material.

I claim:

1. A method of manufacturing a module having at least one solid magnetic core, said at least one solid magnetic core having an electrically insulating top surface and an electrically insulating bottom surface, said module comprising at least one of a transformer module and an inductor module and said module having at least a first and a second electrical output for connecting said module to circuitry external to said module, said method comprising the steps of:

obtaining said at least one solid magnetic core;

obtaining an electrically conductive base plate that is dimensioned to cover said bottom surface of said at least one solid magnetic core, said base plate being manufactured of a material having sufficient electrical conductivity to allow said base plate to serve as a termination in a power converter;

obtaining an electrically conductive top plate that is dimensioned to cover said top surface of said at least one solid magnetic core, said base plate being manufactured of a material having sufficient electrical conductivity to allow said base plate to serve as a termination in a power converter;

bonding said bottom surface of said at least one solid magnetic core directly to said conductive base plate;

bonding said conductive top plate directly to said top surface of at least one solid magnetic core;

connecting the at least a first output to said conductive base plate; and connecting the at least a second output to said conductive top plate;

wherein at least one of said steps of obtaining said conductive base plate and obtaining said conductive top plate further comprises obtaining a conductive plate manufactured of a material that is both electrically conductive and thermally conductive and has at least one surface dimensioned to serve as a heat conductive path to a heat sink; and wherein said resulting module may utilize said conductive base plate as a first termination and may utilize said conductive top plate as a second termination and may utilize at least one surface of one of said conductive base plate and said conductive top plate as a heat conductive path to a heat sink.

2. The method as claimed in claim 1:

wherein said obtaining step comprises obtaining a solid transformer magnetic core comprising at least a center-tapped secondary winding having a first end, a second end, and a center-tap, and obtaining a solid inductor magnetic core having thereon at least an inductor winding having a first termination and a second termination; and further comprising the steps of connecting said center-tap of said center-tapped secondary winding to a first termination of the inductor winding, and connecting said second termination of said inductor winding to said conductive top plate.

3. The method as claimed in claim 1 wherein each of said steps of obtaining said conductive base plate and obtaining said conductive top plate further comprise obtaining a conductive plate manufactured of a material that is both electrically and thermally conductive and has at least one surface dimensioned to serve as a heat conductive path to a heat sink.

* * * * *